United States Patent [19]

Krauss

[11] Patent Number: 4,525,901

[45] Date of Patent: Jul. 2, 1985

[54] BUCKLE HAVING IMPROVED WEB SECUREMENT

[75] Inventor: Mark J. Krauss, New York, N.Y.

[73] Assignee: American Cord & Webbing Co., Inc., New York, N.Y.

[21] Appl. No.: 554,545

[22] Filed: Nov. 23, 1983

[51] Int. Cl.[3] ..... A44B 11/02

[52] U.S. Cl. ..... 24/200; 24/193; 24/197

[58] Field of Search ..... 24/200, 197, 198, 170, 24/182, 193, 68 CD, 69 CT, 265 CD

[56] References Cited

U.S. PATENT DOCUMENTS

| | | | |
|---|---|---|---|
| 2,302,258 | 11/1942 | Rose et al. | 24/197 |
| 2,513,169 | 6/1950 | Griswold | 24/170 |
| 3,192,588 | 7/1965 | White | 24/200 |
| 3,336,639 | 8/1967 | Rutty et al. | 24/200 |
| 3,376,613 | 4/1968 | Lindblad | 24/200 |
| 3,686,715 | 8/1972 | Brodnicki | 24/265 CD |
| 3,696,471 | 10/1972 | Mermelstein | 24/193 |
| 4,171,555 | 10/1979 | Bakker et al. | 24/200 |
| 4,387,490 | 6/1983 | Blackburn et al. | 24/200 |
| 4,395,803 | 8/1983 | Krauss | 24/200 |

FOREIGN PATENT DOCUMENTS

| | | | |
|---|---|---|---|
| 175007 | 2/1922 | United Kingdom | 24/200 |

*Primary Examiner*—Victor N. Sakran
*Attorney, Agent, or Firm*—Marvin Feldman

[57] ABSTRACT

A buckle for securing the free end of a web or band is provided with a cross-member of generally triangular cross-section having rounded corners and slightly curved sides, and being oriented to an upper surface having a sharp angle so that one corner of the cross-member is juxtaposed to the sharp angle. The triangular shape is about an equilateral triangle.

9 Claims, 3 Drawing Figures

BUCKLE HAVING IMPROVED WEB SECUREMENT

FIELD OF THE INVENTION

This invention relates to buckles for securing the free ends of a web or band.

BACKGROUND OF THE INVENTION

The present applicant has filed a patent application, U.S. Ser. No. 251,062, on Apr. 6, 1981, now U.S. Pat. No. 4,395,803, granted Aug. 2, 1983, directed to providing oval shaped cross-members for securing a pair of opposing free ends of a belt or strap.

DISCUSSION OF THE PRIOR ART

British Pat. No. 175,007 dated Feb. 1, 1922, discloses a metal buckle having a plurality of cross-members of approximately rectilinear configuration for securing the free ends of a strap.

SUMMARY OF THE INVENTION

The invention is directed to a buckle having a novel configuration crossbar, namely a triangular cross-section cross-bar having rounded corners or apices and slightly rounded sides, with the triangle specifically oriented or juxtaposed to an upper, sharply angled portion of the buckle, so that the web free end substantially engages two specific sides and two corners of the cross-member, whereby the retention or securement of the web is accomplished.

DETAILED DESCRIPTION OF THE PREFERRED EMBODIMENTS

Figure 1:
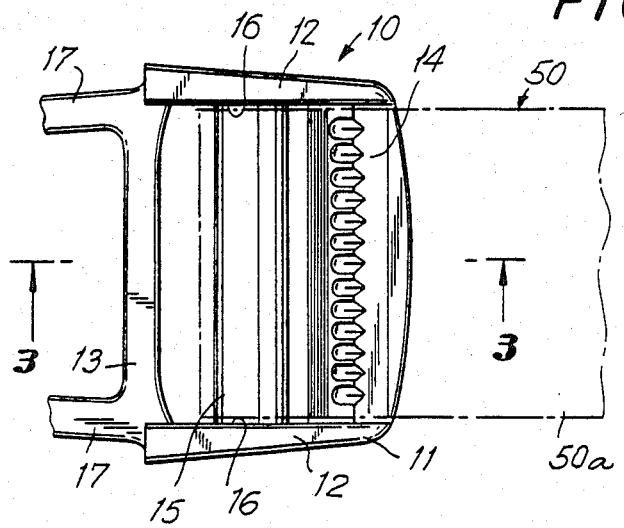
FIG. 1 is a top plan view of one end of a buckle with the web shown in broken line.

Referring to the FIGURES there is shown one molded plastic buckle member 10, or more specifically the web holding or end portion 11 thereof. Buckle member 10 may either be a male or female connect member of an interconnecting buckle, such as the male member of the BSR-1 buckle of American Cord & Webbing Co., Inc., New York, N.Y. 10018.

Web holding portion 11 is generally formed with opposed side walls 12, inner end member 13, with flex male buckle connect members 17 (partially shown) and outer end member 14 so as to form an outer frame 40, with novel triangular cross-member 15 integrally connected to walls 12 as at inner surfaces 16. End member 14 is formed with outer wall 18, lower wall 19, curved upper wall 20, upper wall 21 forming upper plane 22, and being formed with molded teeth or serrations 23, and angled or oblique wall 24 forming acute angle 25 at rounded corner 26.

It is to be noted that angle 25 is generally less than 90°.

Crossbar or member 15 is of generally equilateral triangular cross-section 28 having rounded corners 29*a*–29*c* and curved sides 30*a*–30*c*. The radius of curvature of the sides is quite large so that there is a slight degree of curvature in each side.

It is another important aspect of the invention in that the triangular crossbar or member 15 is specifically oriented in relation to angle 25, namely, one corner 29*a* is facingly disposed and juxtaposed to corner 26, while corners 29*b* and 29*c* are remotely disposed from corner 26.

Figure 2:
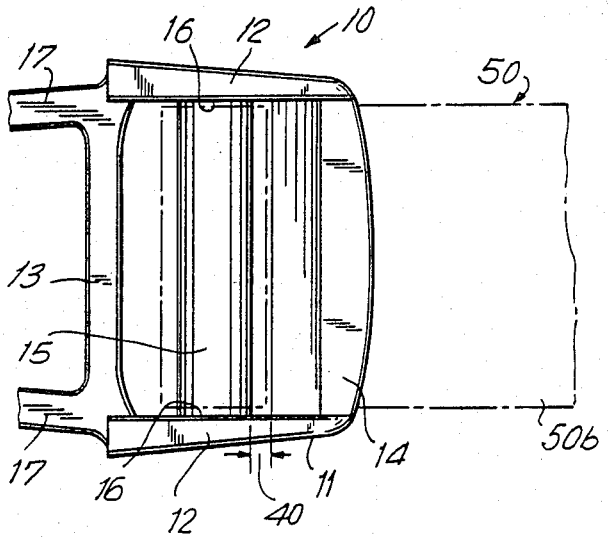
FIG. 2 is a bottom plan view of the buckle of FIG. 1.
Figure 3:
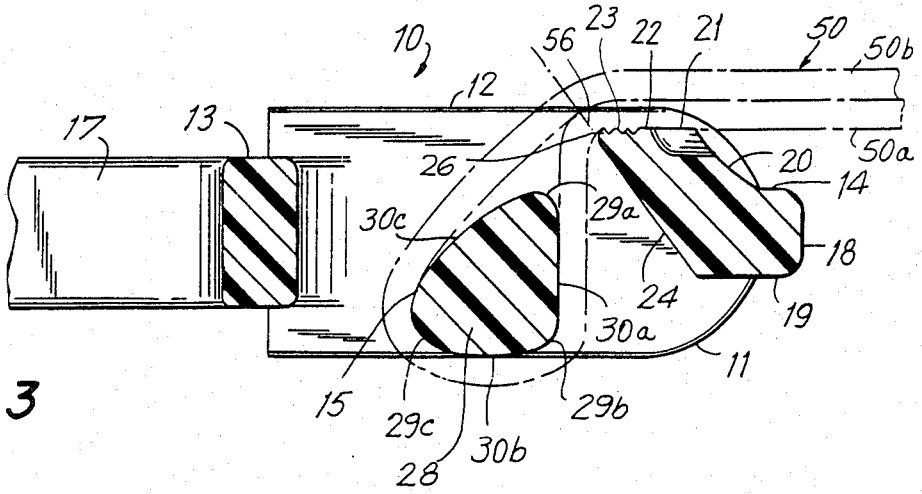
FIG. 3 is an enlarged sectional view taken along line 3—3 of FIG. 1.

A limited space 40 (FIG. 2) of about 0.5 inches as measured in plan view is provided between side 30*a* and corner 26. This space requirement is found to be important in combination with the triangular crossbar and angled surface.

In the aforesaid manner of construction, web 50 is passed between walls 12 and engages corner 29*c*, side 30*b*, corner 29*b* and side 30*a*, and passed upwardly to engage corner 26 and lie flat across serrations 23 and upper plane or surface 22. Corner 29*a* and side surface 30*c* do not engage web 50.

To adjust the web using free end 50*a* thereof, the end member 14 is first lowered. Then, depending upon whether one chooses to lengthen or shorten the web, either free end 50*a* or portion 50*b* is pulled.

It is of course understood that the present web securing mechanism may be used on a broad spectrum of buckles, and the invention is not to be limited to any one particular type of buckle.

There has thus been shown a molded plastic buckle having a novel crossbar configuration and orientation which securely holds the web in place.

Although specific embodiments of the invention have been described, modifications and changes may be made therein without departing from the scope of the invention as defined in the appended claims.

I claim:

1. A buckle for improved securing of a web comprising opposing side walls, first and second opposing end walls attached to said side walls, said first end wall comprising an upper surface and having a corner edge forming an angle of less than 90° with said upper surface, and a cross-bar integrally connected to said side walls and fixedly disposed in relation to the corner edge, and wherein said cross-bar has a generally triangular cross section, and wherein one angle of the cross section triangle is facingly disposed to said corner edge, and the other angles of said triangle are remotely disposed from said corner edge, whereby the web overlies two entire sides and the two remotely disposed angles of the tirangle with a portion of the web engaging the corner edge.

2. The buckle of claim 1, wherein the corners of the cross-bar forming the triangle are rounded.

3. The buckle of claim 2, wherein the sides of the crossbar forming the triangle are curved.

4. The buckle of claim 3, wherein the triangle is an equilateral triangle.

5. The buckle of claim 4, wherein the distance between the side of the crossbar most adjacent the corner edge and the corner edge, as measured in plan view of the buckle, is about 0.5 inch.

6. The buckle of claim 1, said buckle being formed of molded plastic.

7. The buckle of claim 1, wherein the crossbar is parallel to said corner edge and perpendicular to said side walls.

8. The buckle of claim 1, wherein one angle of the triangle of cross-section is facingly disposed to said corner edge, and the other angles of said triangle are remotely disposed from said corner edge, and wherein the triangle is an equilateral triangle.

9. In combination, a web having a free end; and a buckle for improved securing of a web comprising opposing side walls, first and second opposing end walls attached to said side walls, said first end wall comprising an upper surface and having a corner edge forming an angle of less than 90° with said upper surface, and a cross-bar integrally connected to said side walls and fixedly disposed in relation to the corner edge, and wherein said cross-bar has a generally triangular cross section, and wherein one angle of the cross section triangle is facingly disposed to said corner edge, and the other angles of said triangle are remotely disposed from said corner edge whereby the web overlies two entire sides and the two remotely disposed angles of the triangle with a portion of the web engaging the corner edge.

* * * * *